United States Patent [19]

Reinders

[11] Patent Number: 5,074,328

[45] Date of Patent: Dec. 24, 1991

[54] METERING DEVICE FOR A WATER-ACTIVATABLE AGENT

[75] Inventor: Ruldolf Reinders, Emmerich, Fed. Rep. of Germany

[73] Assignee: Polypack R. Reinders Produktionsgesellschaft MBH, Emmerich, Fed. Rep. of Germany

[21] Appl. No.: 667,104

[22] Filed: Mar. 11, 1991

[30] Foreign Application Priority Data

Mar. 16, 1990 [DE] Fed. Rep. of Germany ..... 4008429

[51] Int. Cl.[5] ..... E03D 9/02

[52] U.S. Cl. ..... 137/268; 422/267; 4/227; 4/228

[58] Field of Search ..... 137/268; 422/261, 267, 422/275; 4/223, 224, 227, 228, 231

[56] References Cited

U.S. PATENT DOCUMENTS

| | | | |
|---|---|---|---|
| 1,904,428 | 4/1933 | Enemark | 137/268 X |
| 4,168,551 | 9/1979 | Hautmann | 4/231 |
| 4,350,666 | 9/1982 | Klutts | 137/268 X |
| 4,777,670 | 10/1988 | Klinkhammer | 422/275 X |

*Primary Examiner*—Alan Cohan

*Attorney, Agent, or Firm*—Hoffman & Baron

[57] ABSTRACT

A metering device for a water-activatable agent comprises a container providing a certain water-receiving volume, with a water inlet for water to pass into the container and at least one water outlet opening. Disposed in the container is a carrier tube filled with a porous filling material accommodating the water-activatable agent which may be a perfume, a cleaning agent, a disinfecting agent or the like. Water passing into the container through the water inlet flows controlledly out of the water outlet opening, taking a metered amount of water-activatable agent with it.

9 Claims, 3 Drawing Sheets

FIG. 2
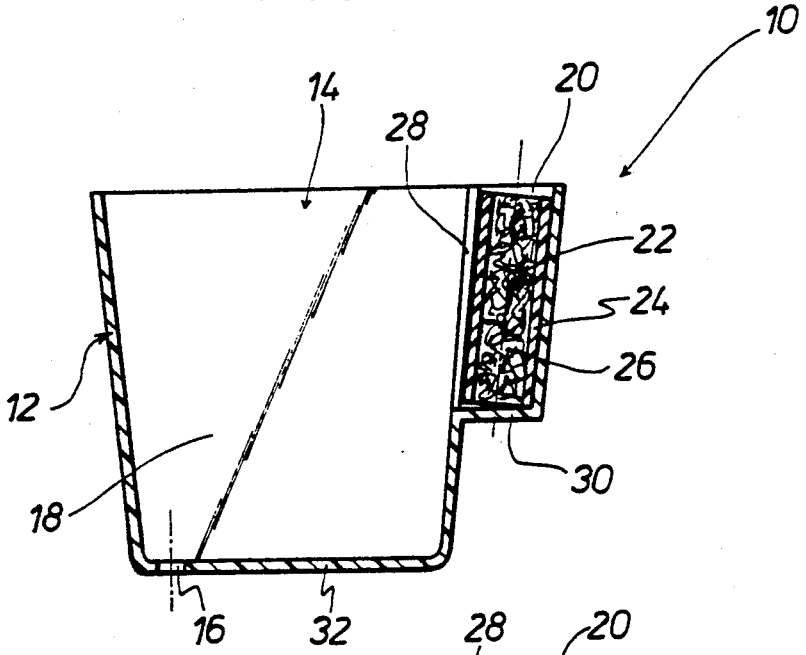
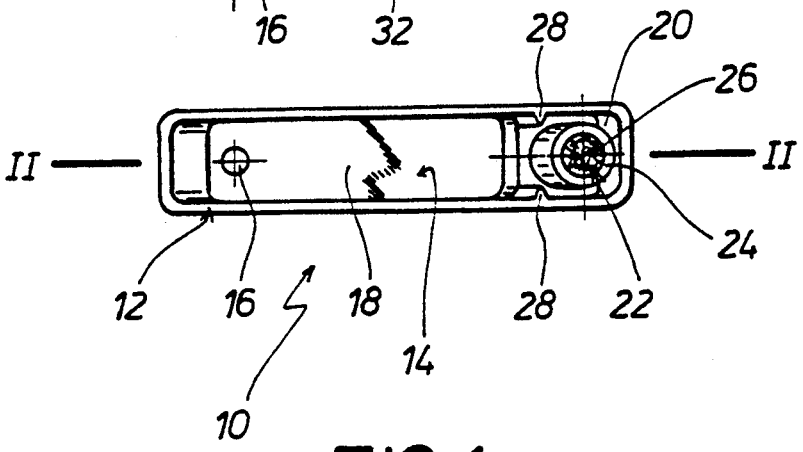
FIG. 1

METERING DEVICE FOR A WATER-ACTIVATABLE AGENT

BACKGROUND OF THE INVENTION

A typical form of a metering device for a water-activatable agent is a WC sanitising device which is operative to provide a metered feed of the water-activatable agent into the flushing water, each time that the WC unit is flushed. Such a device may comprise a container which accommodates a carrier body for the water-activatable agent. The container is provided with openings in a mesh or lattice-like configuration so that the carrier body for the water-activatable agent which may be for example a water-activatable perfume or like material, can be replaceably disposed in the container. The carrier body for the water-activatable agent will usually comprise a water-soluble granulate material so that after a number of flushing operations the carrier body is itself consumed. That form of metering device suffers from the deficiency that it is only precisely during a flushing operation that the water-activatable agent is fed into the flushing water, by virtue of partial dissolution of the carrier body, and thus disappears into the drainage system simultaneously with the flushing water. As a result, the actually desired effect of the water-activatable agent, after a flushing operation, is of only a minimal extent with that kind of device, being of the order of magnitude of about 10% whereas about 90% of the water-activatable agent simply disappears into the drainage system without actually producing its proper or full effect.

SUMMARY OF THE INVENTION

An object of the present invention is to provide a metering device for a water-activatable agent, which does not suffer from the deficiencies of the device referred to above.

Still another object of the present invention is to provide a metering device for a water-activatable agent in which the effect of said agent is operative with a time delay in relation to a flushing operation in relation to the device.

Still another object of the present invention is to provide a metering device for a water-activatable agent, which is so designed that said agent produces an enhanced and improved effect, at a reasonable production cost for the device.

Still a further object of the present invention is to provide a metering device for a water-activatable agent which is of a simple design configuration and easy to handle while being highly effective.

In accordance with the principles of the present invention the foregoing and other objects are achieved by a metering device for an agent which is adapted to be activated by water, comprising a container and a carrier means for the water-activatable agent, the carrier means being disposed in the container. The container defines a certain water-receiving volume and comprises a water inlet for the feed of water into the container, and at least one water outlet for the discharge of water from the container. The carrier means for the water-activatable agent is in the form of a small tube filled with a filling material which provides porosity.

By virtue of the container being designed to provide a certain water-receiving volume, with at least one water outlet opening for the discharge of water from the container after filling thereof, the container is filled with an accurately defined amount of water, for example in each individual flushing operation when the metering device is used in a WC sanitisation situation. After termination of the flushing action, the amount of water which has been introduced into the container by virtue of the flushing procedure is emptied therefrom, within a certain period of time. That time-delayed emptying of the container results in a corresponding amount of the water-activatable agent being discharged from the carrier means of the metering device. That in turn means however that thus the water-activatable agent is not for the major part immediately flushed into the drainage system with the flushing water, but rather provides that, after the flushing operation is terminated, the water-activatable agent is discharged from the container in a controlled manner and in a given period of time which is governed by the at least one water outlet opening in the container. By virtue of that design configuration, the water-activatable agent can produce a considerably better effect than in the case of the metering device discussed above, with its attendant disadvantages. The fact that the carrier means is in the form of a tube filled with a suitable filling material affording porosity to contain the water-activatable agent means that the carrier means itself is simple to produce and thus its production costs are low, which results in the dual advantage that the production costs of the metering device itself are also low, while affording optimum effectiveness, and in addition the cost of refilling the metering device with a fresh carrier means containing water-activatable agent can also be inexpensive.

In a preferred feature of the invention the tube member constituting the carrier means for the water-activatable agent comprises a plastic material and the filling material with which the tube member is filled, providing suitable porosity, may be for example absorbent cotton or a fiber material. It will be appreciated that it would also be possible to use any other suitable material as the filling for the tube member, in order to provide a suitable storage configuration with appropriate porosity for the water-activatable agent in the tube member.

Preferably the filling material in the tube member is saturated or impregnated with a perfume material and/or cleaning agent and/or disinfecting agent, or the like, constituting the water-activatable agent. The delayed discharge of a relatively accurately metered amount of the water-activatable agent after a WC-flushing operation affords the advantage that both a perfume material used and also a cleaning or disinfecting agent employed can produce a considerably better effect, approaching the optimum action in respect thereof, than in the case of the previous metering device as described above in which, in terms of order of magnitude, around 90% of the water-activatable agent is discharged into the drainage system virtually without any effect whatsoever, during the flushing operation. As a result of the comparatively high level of effectiveness of the water-activatable agent in the metering device according to the invention it is advantageously possible to use the water-activatable agent at a relatively low level of concentration, thus in turn leading on to the further considerable advantage of improved environmental protection.

A preferred configuration of the metering device according to the invention provides that the container has a receiving compartment for receiving the carrier means, in its interior of a defined water-receiving volume. The receiving compartment can receive at least one carrier means for the water-activatable agent, in a defined manner, so that the same conditions as occur in regard to discharge of the water-activatable agent can obtain at any time, that is to say for example in any flushing operation.

In accordance with a further preferred feature of the invention the container of the metering device of the invention may include in its interior at least one water baffle or guide portion, wherein the carrier means for the water-activatable agent is disposed in the path of the flow of water which is guided by the at least one baffle or guide portion. In that structure the or each water baffle or guide portion may be in the form of an intermediate plate portion in order suitably to guide water which flows into the interior of the container during a flushing operation, and thereby further to delay the discharge flow out of the container of the amount of water which is precisely defined within the container, so that the effectiveness of the water-activatable agent is further improved in that fashion. The at least one water guide portion in the form of an intermediate plate portion provides what might be referred to as a cascade-type flow through the interior of the container of the metering device.

In another preferred feature of the invention, which can be produced at relatively low cost levels, the container is formed by a front portion and a rear portion which comprise plastic material, being connected together by means of a film hinge. Such a container can be produced in a single molding operation in a relatively short production cycle time, while the integral configuration of the container means that there is the advantage that the handling involved for assembly of the container is also low.

Further features, details and advantages of the present invention will be apparent from the following description of preferred embodiments of the metering device according to the invention.

BRIEF DESCRIPTION OF THE DRAWINGS

FIG. 1 is a view from above of a first embodiment of the metering device according to the invention, FIG. 2 is a view in section taken along line II—II in FIG. 1.

DESCRIPTION OF THE PREFERRED EMBODIMENTS

Figure 3:
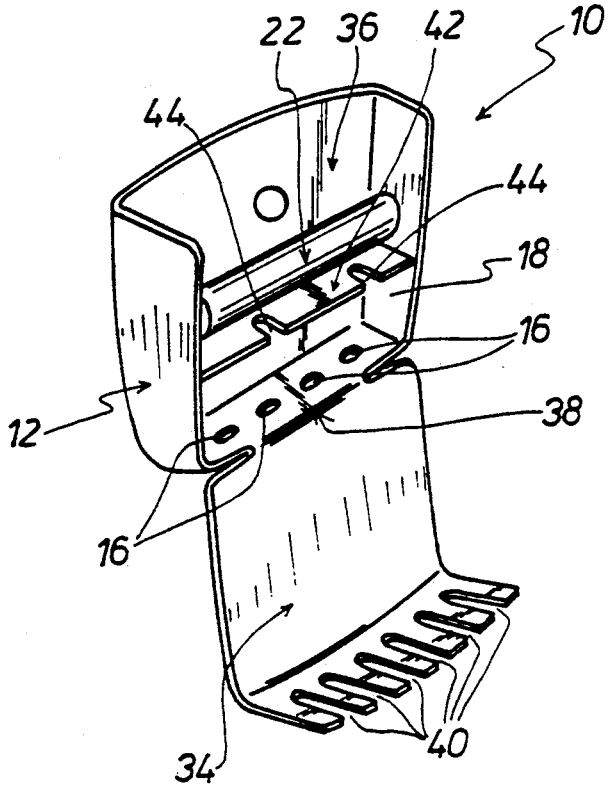
FIG. 3 is a perspective front view of a second embodiment of the metering device with the container in an open condition.

Reference will first be made to FIGS. 1 and 2 showing a first embodiment of a metering device as indicated generally at 10, according to the invention, for an agent which is adapted to be activated by water, referred to herein as a water-activatable agent.

Looking therefore at FIGS. 1 and 2, the construction of the metering device 10 shown therein comprises a container 12 which provides a certain water-receiving volume, with a water inlet as indicated generally at 14, and at least one water outlet opening 16. The water outlet opening 16 is preferably disposed at the part of the container 12 which in use of the metering device is the lowest location thereof in order to guarantee reliable emptying of the container 12. In its interior as indicated at 18 the container 12 defines a receiving compartment 20 for accommodating at least one carrier 22. The carrier 22 is provided for the storage of a water-activatable agent which may be for example a scent or perfume material and/or a cleaning agent and/or a disinfecting agent or the like. The carrier 22 comprises a small tube member 24 filled with a filling material indicated diagrammatically at 26. The filling material 26 which may be any suitable material such as for example absorbent cotton, fiber material or the like provides in the interior of the tube member 24 an open-pore volume which serves to accommodate and store the above-mentioned water-activatable agent.

Reference numeral 28 identifies ribs which, as can be clearly seen from FIG. 1, project into the interior 18 of the container 12 and define the boundary of the receiving compartment 20 for accommodating the carrier 22. As can be seen from FIG. 2, the compartment 20 has a bottom 30 which is arranged at a spacing above the bottom 32, which has the water outlet opening 16, of the main body portion of the container 12, so that in for example a flushing operation, the entire interior 18 of the container 12 is first filled with water, and that water then runs out through the water outlet opening 16. As that happens, the level of water in the interior 18 of the container 12 falls, the carrier 22 first being disposed above the level of the water in the interior 18 when that water falls below the level of the bottom 30 of the receiving compartment 20. At the same time water which is retained in the carrier 22 is passed with water-activatable agent into the remaining volume of water contained in the interior 18 of the container 12, and is discharged with that remaining volume of water through the water outlet opening 16. That thus provides for a delayed discharge of a more or less accurately metered amount of water-activatable agent which was stored in the carrier 22, after termination of the flushing operation which resulted in initial filling of the container 12, with the result that the water-activatable agent can produce a good and efficient effect.

Figure 4:
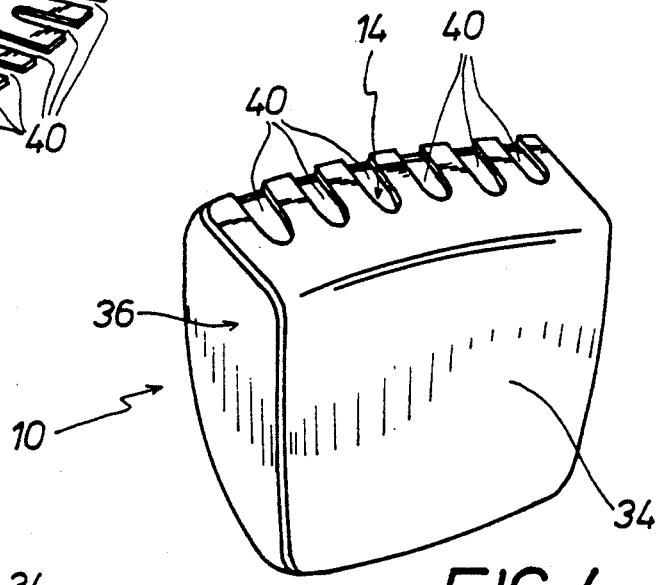
FIG. 4 is a perspective front view of the embodiment of the metering device shown in FIG. 3, in the closed condition.
Figure 5:
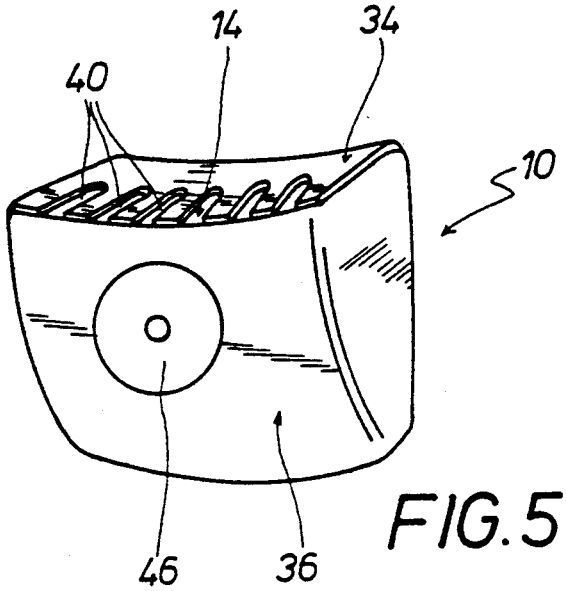
FIG. 5 is a perspective rear view of the metering device shown in FIGS. 3 and 4.

Reference will now be made to FIGS. 3 through 5 showing a second embodiment of the metering device according to the invention in which the container 12 comprises a front portion 34 and a rear portion 36 which are connected together by means of a film hinge diagrammatically indicated at 38. That construction provides a container of a simple design configuration.

Provided at the bottom of the rear portion 36 of the container 12 are a number of water outlet openings 16. The front portion 34 has slots 40 which, in the operative condition of the metering device 10, provide the water inlet as indicated at 14 in FIGS. 4 and 5.

Disposed in the interior 18 of the container 12 or more precisely in the interior of the rear portion 36 thereof is a water baffle or guide portion 42 which is of a strip-like configuration, thus defining an intermediate plate portion within the container 12. The portion 42 is provided with openings 44 therethrough. A carrier 22 for a water-activatable agent lies on the water guide portion 42, in the manner clearly visible in FIG. 3. The water-activatable agent may be any suitable material such as a scent or perfume material and/or a cleaning agent and/or a disinfecting agent or the like. The carrier 22 is of a similar nature to that shown in FIGS. 1 and 2 and described hereinbefore in relation to those Figures, so that there is no need at this point to provide another detailed description thereof.

As shown in FIG. 5, projecting from the rear side of the rear portion 36 of the metering device 10 is a fixing member 46 which may be for example a suction cap comprising a resiliently flexible material. It will be appreciated that the fixing member 46 may also comprise any other suitable form of fixing member such as at least one fixing hook.

Figure 6:
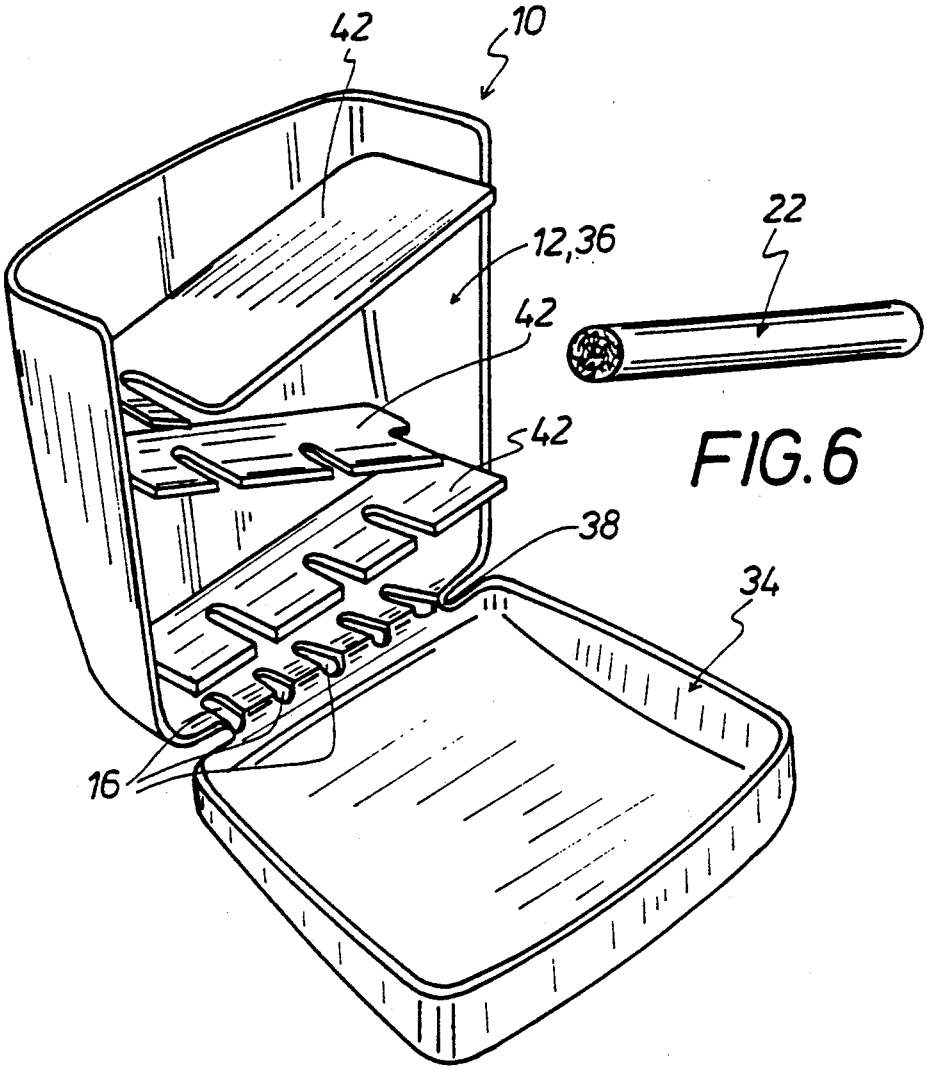
FIG. 6 is a perspective view of a third embodiment of the metering device according to the invention, in an open condition, with a carrier for the water-activatable agent shown at a spacing from the remainder of the metering device.
Figure 7:
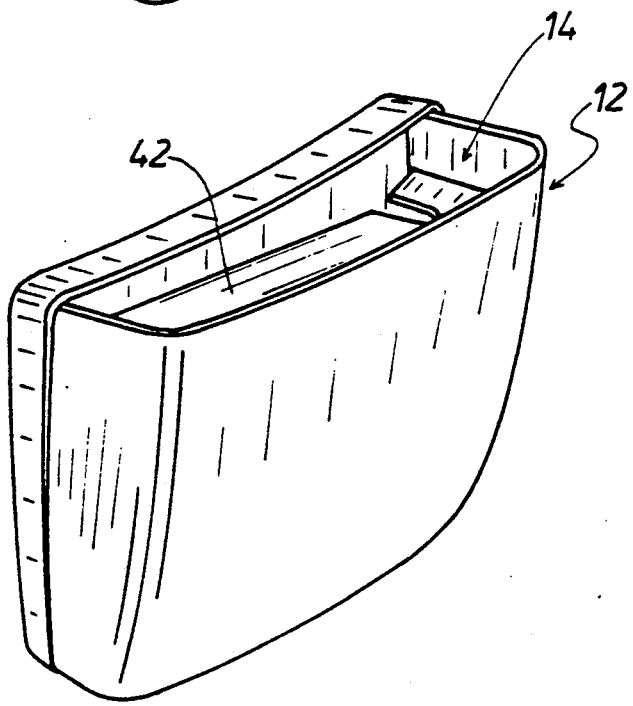
FIG. 7 is a perspective view of the metering device shown in FIG. 6 in the closed condition and thus in the position of use thereof.

Reference will now be made to FIGS. 6 and 7 showing a third embodiment of the metering device 10 according to the invention, in which the container 12 thereof comprises a front portion 34 and a rear portion 36 which are suitably connected together by means of a film hinge diagrammatically indicated at 38. Disposed in the interior of the container 12 or more specifically the rear portion 36 thereof are a plurality of strip-like water baffle or guide portions 32 which provide that the water which is introduced into the container 12 through the water inlet indicated at 14 in FIG. 7 is guided in a cascade flow-like configuration through the container 12 as it flows downwardly through the interior of the container from the water inlet 14. The water then leaves the container 12 again, with a time delay, through the water outlet openings indicated at 16 in FIG. 6. Reference numeral 22 in FIG. 6 identifies a carrier which is shown separately from the container 12. The carrier 22 in FIG. 6 is of the same configuration as the carrier 22 shown in FIGS. 1 and 2 and described hereinbefore with reference thereto. The carrier 22 can be arranged to lie on one of the water guide or baffle portions 42 in the interior of the container 12, in which respect it is appropriate for the carrier 22 to be supported on the middle water guide portion 42.

It will be appreciated that the above-described metering devices according to the invention have been set forth solely by way of example and illustration thereof and that various other modifications and alterations may be made therein without thereby departing from the spirit and scope of the invention.

What is claimed is:

1. A metering device for a water-activatable agent comprising: a container affording a water-receiving volume and including a water inlet and at least one water outlet; and a carrier means for the water-activatable agent, said carrier means being disposed in the container and being in the form of a tube means filled with a filling material which provides porosity adapted to accommodate said water-activatable agent.

2. A metering device for a water-activatable agent comprising:

a container affording a water-receiving volume and including a water inlet and at least one water outlet; and a carrier means for said water-activatable agent, said carrier means being disposed within said container and being in the form of a tube member filled with a filling material providing porosity and adapted to accommodate said water-activatable agent, the tube member comprising a plastic material and the filling material comprising at least one of a fiber material and cotton.

3. A metering device as set forth in claim 1 wherein the tube member comprises a plastic material and the filling material is a fiber material.

4. A metering device as set forth in claim 1 wherein the filling material in the tube means is impregnated with at least one material selected from perfumes, cleaning agents and disinfecting agents, constituting the water-activatable agent.

5. A metering device as set forth in claim 1 wherein the container has a receiving compartment in its interior for receiving the carrier tube means.

6. A metering device as set forth in claim 1 wherein in its interior the container has at least one water guide portion, the carrier tube means being disposed in the path of the flow of water guided by the at least one water guide portion.

7. A metering device as set forth in claim 6 wherein said at least one water guide portion is in the form of an intermediate plate portion.

8. A metering device for a water-activatable agent comprising:

a container affording a water-receiving volume and including a water inlet and at least one water outlet, the container including a front portion and a rear portion which comprise plastic material, and further including a film hinge connecting said front portion and said rear portion together; and a carrier means for said water-activatable agent, said carrier means being disposed within said container and being in the form of a tube member filled with a filling material providing porosity and adapted to accommodate said water-activatable agent.

9. A metering device for a water-activatable agent comprising: a carrier means in the form of a tube member filled with a material providing porosity for accommodating said water-activatable agent; and a container having a water inlet for a feed of water into the interior of the container, a water outlet for the discharge of said water in the container from said container at a slower rate than the feed of water into the container, and means within said container for receiving said tube member such that the space occupied within the interior of said container by said tube member is in communication with said water flowing through said container from said water inlet towards said water outlet, thereby to provide for a controlled metered feed of said water-activatable agent from said tube member into said flow of water.

* * * * *